US008144902B2

(12) United States Patent
Johnston

(10) Patent No.: US 8,144,902 B2
(45) Date of Patent: Mar. 27, 2012

(54) STEREO IMAGE WIDENING

(75) Inventor: James D. Johnston, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 1124 days.

(21) Appl. No.: 11/945,789

(22) Filed: Nov. 27, 2007

(65) Prior Publication Data

US 2009/0136066 A1 May 28, 2009

(51) Int. Cl.
*H04R 5/02* (2006.01)

(52) U.S. Cl. ..... 381/310

(58) Field of Classification Search ..... 381/310
See application file for complete search history.

(56) References Cited

U.S. PATENT DOCUMENTS

| | | | | |
|---|---|---|---|---|
| 5,173,944 | A * | 12/1992 | Begault | 381/17 |
| 5,850,453 | A * | 12/1998 | Klayman et al. | 381/1 |
| 6,337,999 | B1 * | 1/2002 | Orban | 700/94 |
| 6,606,388 | B1 * | 8/2003 | Townsend et al. | 381/17 |
| 6,614,910 | B1 * | 9/2003 | Clemow et al. | 381/1 |
| 6,718,039 | B1 * | 4/2004 | Klayman et al. | 381/1 |
| 6,771,778 | B2 | 8/2004 | Kirkeby | |
| 6,795,556 | B1 * | 9/2004 | Sibbald et al. | 381/17 |
| 7,031,474 | B1 | 4/2006 | Yuen et al. | |
| 7,043,031 | B2 * | 5/2006 | Klayman et al. | 381/98 |
| 7,072,474 | B2 | 7/2006 | Nelson et al. | |
| 7,197,151 | B1 | 3/2007 | Sibbald et al. | |
| 2002/0055827 | A1 * | 5/2002 | Kyriakakis | 703/2 |
| 2004/0247132 | A1 * | 12/2004 | Klayman et al. | 381/1 |
| 2005/0265558 | A1 | 12/2005 | Neoran | |
| 2005/0271214 | A1 | 12/2005 | Kim | |
| 2006/0062395 | A1 * | 3/2006 | Klayman et al. | 381/1 |
| 2006/0115090 | A1 | 6/2006 | Kirkeby | |
| 2007/0019812 | A1 | 1/2007 | Kim | |
| 2007/0133831 | A1 | 6/2007 | Kim et al. | |

OTHER PUBLICATIONS

Zirene, "Audio Enhancement, Mobile Phones and Portable Devices," <http://www.am3d.com/pdf/zirene.pdf>, 2 pages (accessed Sep. 21, 2007).

Azzopardi, "Audio X3 Audio Experience in 3D," Department of Computer Science and AI, University of Malta, <http://www.cs.um.edu.mt/~vsam2/Synopsis/docs/Azzopardi%20Kurt.pdf>, 12 page (May 2007).

Walker, "Stereo Image Trickery With PC Plug-ins, PC Musician," *Sound on Sound*, <http://www.soundonsound.com/sos/jan07/articles/pcmusician_0107.htm>, 6 pages (Jan. 2007).

Gardner, "3D Audio and Acoustic Environment Modeling," < http://www.harmony-central.com/Computer/Programming/3d-audio.pdf>, 9 pages (Mar. 15, 1999).

* cited by examiner

*Primary Examiner* — Lincoln Donovan
*Assistant Examiner* — Alexander Talpalatskiy
(74) *Attorney, Agent, or Firm* — Klarquist Sparkman, LLP

(57) ABSTRACT

A stereo image can be widened by converting a stereo audio signal into a sum-difference audio signal, applying HRTF processing to the difference channel, and producing an output stereo audio signal. A stereo image can also be widened by receiving a stereo signal, converting the stereo signal into a sum-difference signal, applying HRTF processing to only the difference channel, upsampling the sum-difference signal, applying distortion, downsampling the sum-difference signal, and converting the sum-difference signal into a stereo signal. A system for widening a stereo image can comprise an input module configured to convert a stereo audio signal into a sum-difference audio signal, an HRTF module configured to apply HRTF processing to only the difference channel, a distortion module configured to apply a first distortion to the sum channel and a second different distortion to the difference channel, and an output module configured to produce an output stereo audio signal.

20 Claims, 6 Drawing Sheets

STEREO IMAGE WIDENING

BACKGROUND

In part, the quality of audio that is played back to a listener depends on how the audio was recorded and how the audio was compressed/decompressed (if at all). A playback device can sometimes perform processing during playback, however, to improve the listening experience.

When stereo audio is played back, a stereo image is created. The stereo image created during playback is typically limited to the space between the speakers. If the speakers are spaced close together, the stereo image can be limited to a small space between the speakers, which can be an undesirable effect.

In order to obtain a wider stereo image, speakers can be placed further apart. However, placing speakers further apart may not be practical or possible. For example, available space for speaker placement may be limited (e.g., a small room or other obstacles).

Therefore, there exists ample opportunity for improvement in technologies related to stereo image widening.

SUMMARY

In summary, the detailed description is directed to various techniques and tools for widening a stereo image. For example, stereo image widening can be applied during audio playback using an audio playback device.

According to one aspect of the techniques and tools described herein, stereo image widening comprises converting a stereo audio signal into a sum-difference audio signal, applying head-related transfer function (HRTF) processing to the difference channel, and producing an output stereo audio signal by converting the HRTF-processed sum-difference audio signal into the output stereo audio signal. Instead of, or in addition to, the HRTF processing, distortion can be applied to the sum-difference audio signal (e.g., different distortion for the sum and difference channels). In some implementations, HRTF processing is applied to only the difference channel. In other implementations, HRTF processing is applied to both the sum and difference channels.

In another aspect, stereo image widening comprises converting a stereo audio signal into a sum-difference audio signal, applying head-related transfer function (HRTF) processing to only the difference channel, applying non-linear processing (comprising upsampling, applying distortion using a non-linearity of order N, and downsampling), and producing an output stereo audio signal by converting the processed sum-difference audio signal into the output stereo audio signal.

In another aspect, a system for widening a stereo image comprises an input module configured to convert a stereo audio signal into a sum-difference audio signal, an HRTF module configured to apply HRTF processing to only the difference channel, a distortion module configured to apply different distortion to the sum and difference channels, and an output module configured to produce an output stereo audio signal by converting the HRTF-processed and distorted sum-difference audio signal into the output stereo audio signal.

In yet another aspect, stereo image widening comprises receiving a two-channel stereo input audio signal, converting the two-channel stereo input audio signal to a two-channel sum-difference audio signal, applying HRTF processing to only the difference channel, upsampling, applying a first distortion to the sum channel and a second different distortion to the difference channel, downsampling, and producing a two-channel stereo output audio signal by converting the HRTF-processed and distorted two-channel sum-difference audio signal into the two-channel stereo output audio signal The described techniques and tools for stereo image widening can be implemented separately or in combination. The techniques and tools can be implemented using digital audio processing (e.g., implemented by an audio processing device).

DETAILED DESCRIPTION

The following description is directed to techniques, tools, and solutions for widening a stereo image. The various techniques, tools, and solutions can be used in combination or independently. Different embodiments can implement one or more of the described techniques, tools, and solutions.

I. Example Audio Processing Device

The technologies, techniques, and solutions described herein can be implemented on any of a variety of devices in which audio signal processing is performed (e.g., audio processing devices), including among other examples, computers, portable audio players, MP3 players, digital audio/video players, home stereo audio components, PDAs, mobile phones, smart phones, DVD and CD players, audio conferencing devices, computer components such as audio or sound cards, network audio streaming devices, etc. The technologies, techniques, and solutions described herein can be implemented in hardware circuitry (e.g., in circuitry of an ASIC, FPGA, etc.), as well as in audio processing software executing within a computing device or other computing environment (e.g., executed on a central processing unit (CPU), a digital signal processor (DSP), or a combination).

Figure 1:
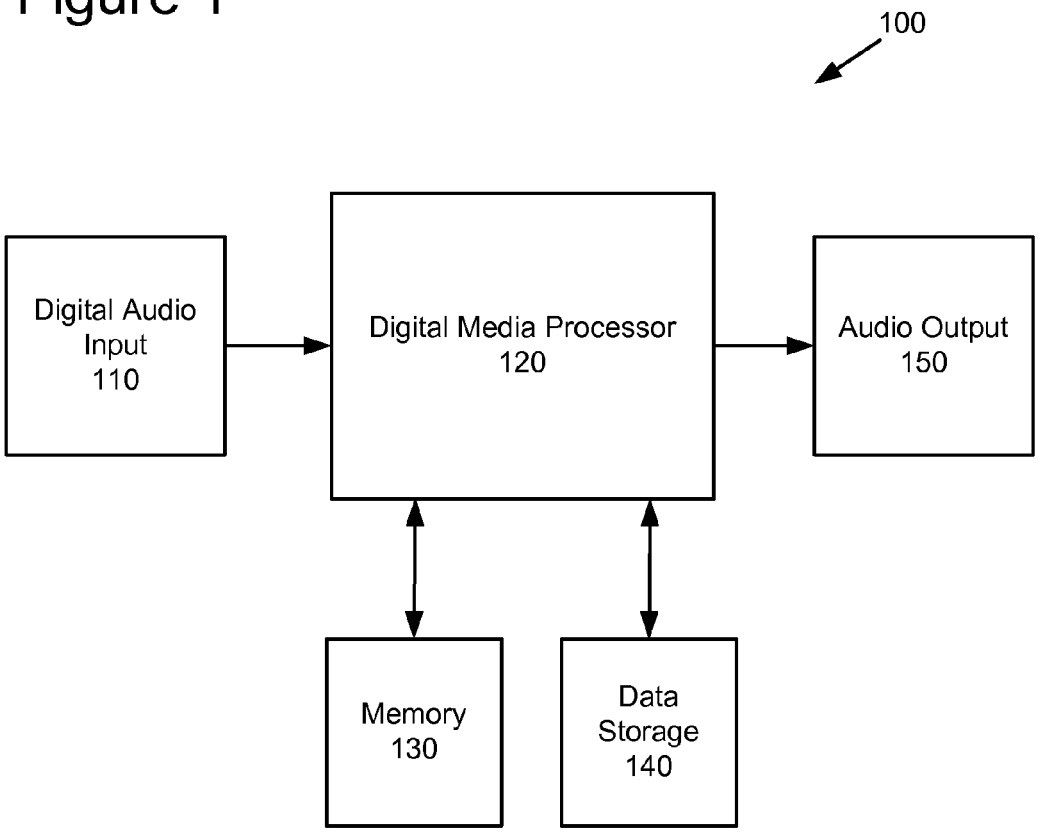
FIG. 1 is a block diagram of a suitable audio processing device in which some described techniques and tools may be implemented.

FIG. 1 depicts a generalized block diagram of a suitable audio processing device 100 in which described embodiments may be implemented. The audio processing device 100 is not intended to suggest any limitation as to scope of use or functionality of the invention, as the present invention may be implemented in diverse general-purpose or special-purpose computing environments.

With reference to FIG. 1, the audio processing device 100 includes a digital audio input 110. The digital audio input 110 can accept one or more channels of digital audio data (e.g., stereo or multi-channel). The digital audio data can be encoded (e.g., MP3, WMA Pro, AAC, etc.). The digital audio input 110 can accept digital audio data from a variety of sources (e.g., a computer, an audio device such as a CD player, a network source such as a wireless media server or streaming audio from the Internet, etc.).

The audio processing device 100 includes a digital media processor 120. The digital media processor comprises one or more processors, such as DSPs and/or CPUs. In a specific implementation, the digital media processor 120 is a DSP. The digital media processor 120 communicates with memory 130. The memory 130 can comprise working memory and/or program memory. The memory 130 can contain program code for operating the digital media processor 120 to implement the technologies described herein. The digital media processor 120 communicates with data storage 140. For example, the data storage 140 can include flash memory and/or hard drive storage for storing digital audio data.

The audio processing device 100 includes an audio output 150. For example, the audio output 150 can be a digital audio output (e.g., for driving a digital audio amplifier) or an analog audio output (e.g., comprising D/A converters and producing an analog audio line out).

For example, the digital media processor 120 can receive a stereo digital audio input signal 110. If necessary, the digital media processor 120 can decode the input signal. The digital media processor 120 can widen the stereo image of the input signal using various combinations of the stereo image widening technologies described herein. For example, the digital media processor 120 can execute instructions from the memory 130 in order to implement various stereo image widening technologies, as well as other audio processing technologies. The processed audio signal can then be output 150. The output audio signal 150, now with a widened stereo image, can be used to drive stereo speakers (e.g., closely spaced stereo speakers that, without the processing to create a widened stereo image, would create a smaller stereo image limited to the space between the speakers).

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "produce," "determine," "receive," "convert," and "apply" to describe computer operations in a computing environment. These terms are high-level abstractions for operations performed by a computer, and should not be confused with acts performed by a human being. The actual computer operations corresponding to these terms vary depending on implementation.

II. Example Audio Playback Environment

Figure 2:
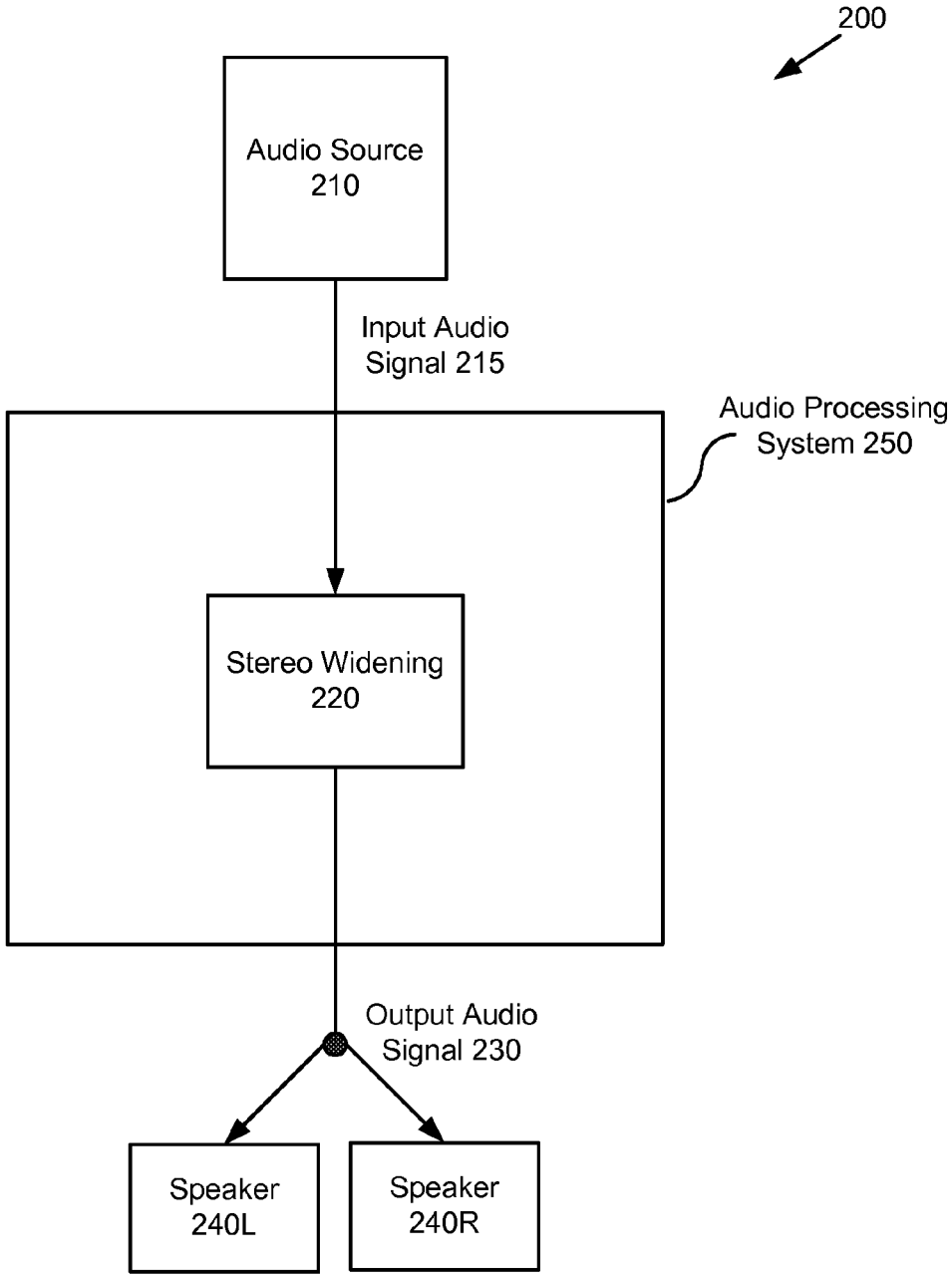
FIG. 2 is a block diagram of an audio playback environment in which one or more of the technologies described herein can be implemented.

FIG. 2 shows an audio playback environment 200 in which stereo image widening technologies may be implemented. In the audio playback environment 200, a stereo audio signal 215 is obtained from an audio source 210, which may be a CD player, digital media device (e.g., a digital audio player), decoder for a digital audio stream (e.g., in a Windows Media Audio (WMA), WMA Pro, or other digital audio format), or other audio signal source. The audio content can be coded and decoded using a variant of WMA Pro, AC3, AAC or other coding/decoding technologies. The audio source 210 can be an external source (as shown in FIG. 2), or internally integrated in the audio processing system 250.

An audio processing system 250 (e.g., an audio playback device) includes stereo widening technology 220. The audio processing system 250 can implement the stereo widening technology 220 using hardware (e.g., DSPs and/or CPUs), software, or a combination of hardware and software. The audio processing system 250 can also implement other audio processing technologies in addition to stereo widening technology 220.

The audio processing system 250 produces an output audio signal 230 with a widened stereo image. The output audio signal 230 is then used to drive (e.g., using an audio amplifier) speakers 240L and 240R (e.g., home audio loudspeakers or computer speakers), or another type of audio output device (e.g., headphones).

The stereo widening technology 220 can apply the various stereo widening techniques described herein (e.g., conversion between stereo and sum-difference signals, HRTF processing, distortion, and/or crossfeed) to widen the stereo image of the input stereo audio signal 215. In various applications, the audio processing system 250 can be implemented using a digital signal processor (DSP) or more generally a central processing unit (CPU) programmed to perform the signal processing techniques described herein.

The relationships shown between modules within the system indicate the main flow of information in the system; other relationships are not shown for the sake of simplicity. Depending on implementation and the type of processing desired in the system of FIG. 2 (or the other systems shown in the various topology and path diagrams presented in other Figures of the application), modules can be added, omitted, split into multiple modules, combined with other modules, and/or replaced with like modules.

III. Innovations in Stereo Image Widening

This section describes stereo image widening techniques and solutions that can be applied to playback of audio (e.g., playback of audio in various types of devices). For example, solutions for widening a stereo image can include one or more of the following features and techniques: converting a stereo audio signal to a sum-difference audio signal, applying HRTF processing to only the difference channel, applying distortion to the sum and difference channels, upsampling and downsampling, converting a sum-difference audio signal to a stereo audio signal, and cross-channel mixing. Stereo image widening solutions can be implemented via software, hardware, or a combination thereof.

In some implementations, the stereo image widening techniques and solutions are used to widen the stereo image produced by closely spaced loudspeakers. In some situations, the stereo image produced by two loudspeakers is limited to the area between the loudspeakers. This effect can be particularly noticeable when the loudspeakers are close together. Widening the stereo image (e.g., such that the stereo image extends beyond the area between the loudspeakers) can be a desirable effect (e.g., it can improve the listening experience).

In some implementations, stereo image widening is accomplished, at least in part, by applying HRTF processing to a difference channel of a sum-difference audio signal. In a specific implementation, HRTF processing is applied using a linear phase filter with the following coefficients (a 30-degree HRTF):

| | |
|---|---|
| −0.000785659085192976 | −0.00152187179883266 |
| 7.38195242492028e−06 | 0.00181478446627138 |
| −0.000365435370496536 | −0.00461995251252313 |
| −0.010683993431805 | −0.00647331583939234 |
| 0.0134831640671979 | 0.00964035803049042 |
| −0.00527722214757629 | −0.00603224448901496 |
| −0.0632898559050404 | −0.0433261481582498 |
| 0.1684119267271 | 0.097014646751721 |
| −0.261468262548719 | −0.0667286706401856 |

-continued

| | |
|---|---|
| 0.184638176774597 | −0.681816037596726 |
| 2.54628300420188 | −0.681816037596726 |
| 0.184638176774597 | −0.0667286706401856 |
| −0.261468262548719 | 0.097014646751721 |
| 0.1684119267271 | −0.0433261481582498 |
| −0.0632898559050404 | −0.00603224448901495 |
| −0.00527722214757629 | 0.00964035803049042 |
| 0.0134831640671979 | −0.00647331583939234 |
| −0.010683993431805 | −0.00461995251252313 |
| −0.000365435370496536 | 0.00181478446627138 |
| 7.38195242492078e−06 | −0.00152187179883267 |
| −0.000785659085192976 | |

In some implementations, stereo image widening is accomplished, at least in part, by applying distortion to sum and difference channels of a sum-difference audio signal. In a specific implementation, distortion is applied using a fourth-order non-linearity, with a stronger fourth-order non-linearity being applied to the difference channel. A specific implementation uses the following polynomials:

Sum channel: $0.025x^4+0.05x^2+x$

Difference channel: $0.125x^4+0.25x^2+x$

In a specific implementation, stereo image widening is implemented as shown in the following pseudocode:

```
// Convert left-right to sum-difference
sum channel=left channel+right channel;
difference channel=left channel−right channel;
// Apply HRTF processing
apply HRTF to difference channel; // using coefficients above
delay sum channel;
// Upsample
upsample sum and difference channels by a factor of 4;
// Apply distortion using polynomials defined above.
// The distortion is relative to a peak value of +/−1, floating point
distort sum channel;
distort difference channel;
// Downsample
downsample sum and difference channels by a factor of 4;
// Convert sum-difference to left-right
left channel=sum channel+difference channel;
right channel=difference channel−sum channel;
// Crossfeed
mix portion, delayed 0.1 ms, of right channel with left channel;
mix portion, delayed 0.1 ms, of left channel with right channel;
```

Figure 3:
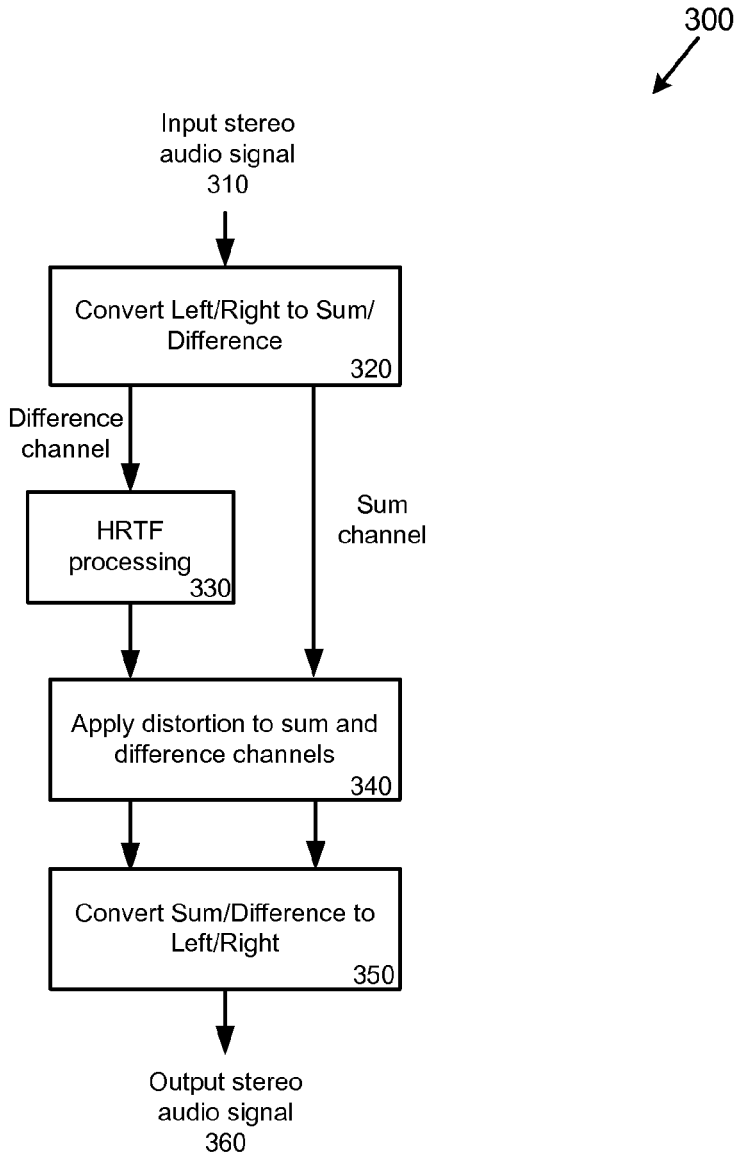
FIG. 3 depicts an example block diagram for stereo image widening.

FIG. 3 depicts a block diagram 300 for stereo image widening. The block diagram 300 can be implemented, for example, by an audio playback device (e.g., implemented using one or more digital signal processors) to widen the stereo image of a stereo audio signal.

In the diagram 300, an input stereo audio signal 310 is received. The input stereo audio signal 310 has left and right audio channels. At 320, the left and right channels of the input stereo audio signal 310 are converted to sum and difference channels. The conversion is accomplished by adding the left and right channels together to produce the sum channel, and by subtracting the right channel from the left channel to produce the difference channel.

At 330, the difference channel undergoes HRTF processing. In a specific implementation, the HRTF processing is performed using a linear phase filter that mimics an HRTF coming from the side of the listener (e.g., using the coefficients listed above). In some implementations, a sample delay is applied to the sum channel.

In some implementations, HRTF processing is applied to only the difference channel 330 (and not to the sum channel). In other implementations, HRTF processing is applied to both the sum and difference channels. In some situations, applying HRTF processing to the sum channel as well as the difference channel can improve the widening effect, but it can also lead to decreased audio quality.

At 340, distortion is applied to the sum and difference channels. In some implementations, the sum and difference channels are distorted differently. For example, distortion can be applied using an Nth-order non-linearity, with a stronger Nth-order non-linearity being applied to the difference channel. In a specific implementation, a fourth-order non-linearity is applied to the sum channel and a stronger fourth-order non-linearity is applied to the difference channel. Depending on the order of the non-linearity, upsampling can be performed before applying the distortion and downsampling can be performed after applying the distortion. In some implementations, the upsampling/downsampling factor is greater than or equal to the order of the non-linearity. In other implementations, the upsampling/downsampling factor is less than the order of the non-linearity.

Instead of applying distortion to both the sum and difference channels, distortion can be applied to only the difference channel. In this alternative implementation, distortion is applied to the difference channel while the sum channel is not distorted.

At 350, the sum and difference channels are converted back to left and right stereo channels. The conversion is accomplished by adding the sum and difference channels together to produce the left channel, and by subtracting the sum channel from the difference channel to produce the right channel. At 360, the stereo audio signal (with the left and right stereo channels) is output.

The stereo image of a stereo audio signal can be widened by digitally processing the stereo audio signal according to various components of the block diagram 300. For example, the audio processing operations depicted in the block diagram 300 can be implemented by one or more DSPs.

In some implementations, stereo image widening can be performed using various combinations of the components depicted in the block diagram 300 (e.g., fewer than all depicted components). For example, in a specific implementation, distortion 340 is not applied.

Figure 4:
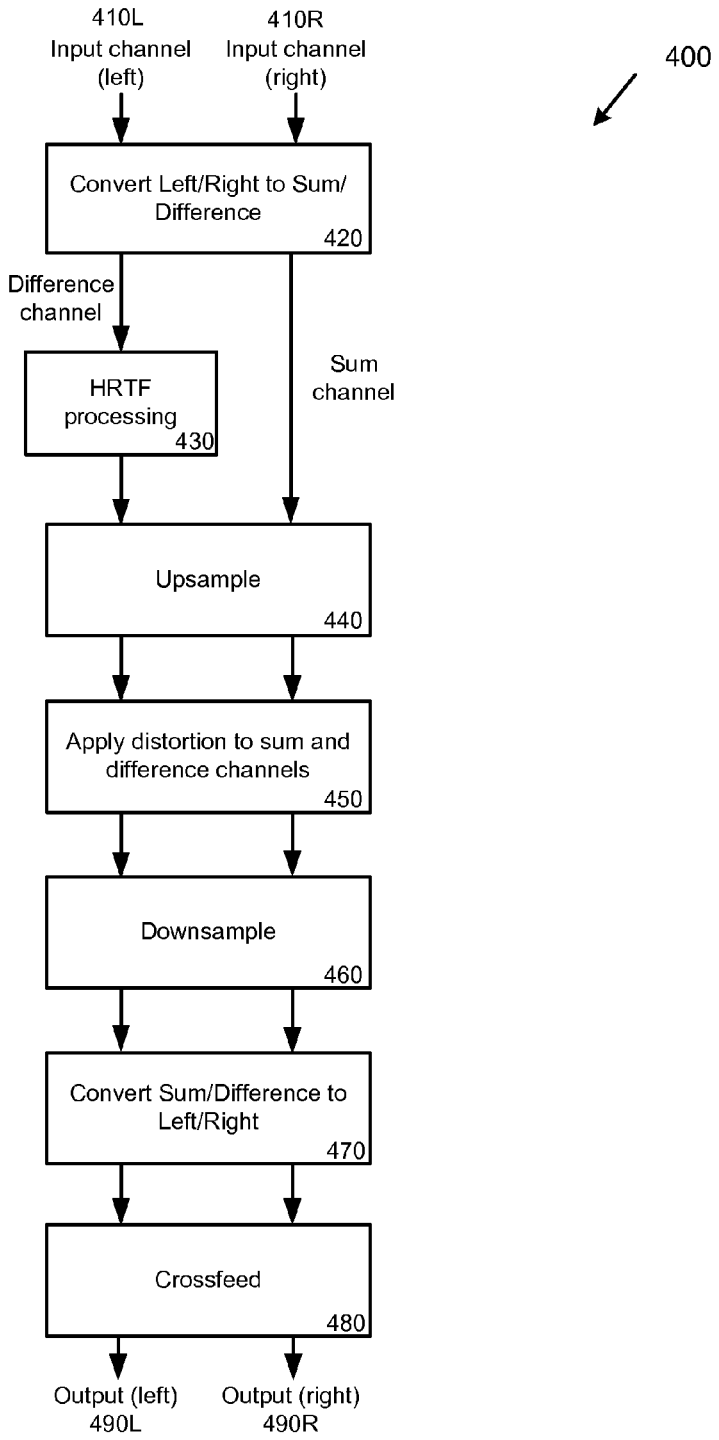
FIG. 4 depicts an example block diagram for stereo image widening, including HRTF processing and distortion.

FIG. 4 depicts a block diagram 400 for stereo image widening, including HRTF processing and distortion. The block diagram 400 can be implemented, for example, by an audio playback device (e.g., implemented using one or more digital signal processors) to widen the stereo image of a stereo audio signal.

In the diagram 400, left and right stereo audio input channels (410L and 410R) are received. At 420, the left and right channels (410L and 410R) are converted to sum and difference channels. The conversion is accomplished by adding the left and right channels together to produce the sum channel, and by subtracting the right channel from the left channel to produce the difference channel.

At 430, only the difference channel (and not the sum channel) undergoes HRTF processing. In a specific implementation, the HRTF processing is performed using a linear phase filter that mimics an HRTF coming from the side of the listener (e.g., using the coefficients listed above).

At 450, distortion is applied to the sum and difference channels. In some implementations, the sum and difference channels are distorted differently. In a specific implementation, a fourth-order non-linearity is applied to the sum channel and a stronger fourth-order non-linearity is applied to the difference channel.

Depending on the order of the non-linearity used to apply the distortion 450, upsampling 440 is applied before applying the distortion and downsampling 460 is applied after applying the distortion. In a specific implementation, where a fourth-order non-linearity is used, the upsampling 440 and downsampling 460 are by a factor of four. Depending on implementation details, the sum and difference channels should be upsampled 440 and downsampled 460 by at least the amount of the highest order non-linearity in order to avoid aliasing problems.

At 470, the sum and difference channels are converted back to left and right stereo channels. The conversion is accomplished by adding the sum and difference channels together to produce the left channel, and by subtracting the sum channel from the difference channel to produce the right channel.

At 480, crossfeed (cross-channel mixing) is applied between the left and right channels. In a specific implementation, the crossfeed includes a delay (e.g., 0.1 ms). Finally, the left and right stereo channels are output (490L and 490R).

The stereo image of a stereo audio signal can be widened by digitally processing the stereo audio signal according to various components of the block diagram 400. For example, the audio processing operations depicted in the block diagram 400 can be implemented by one or more DSPs.

In some implementations, stereo image widening can be performed using various combinations of the components depicted in the block diagram 400 (e.g., fewer than all depicted components). For example, in some implementations, crossfeed 480 is not applied.

The block diagram 400 depicts a single block for performing some audio processing operations. However, it is not required that the same audio processing operations be performed on both channels. In general, channels can be processed independently within a single depicted box. For example, upsampling 440, applying distortion 450, and downsampling 460 can be separately applied to the sum and difference channels using different parameters (e.g., different upsampling/downsampling factors and/or applying a different order non-linearity).

Figure 5:
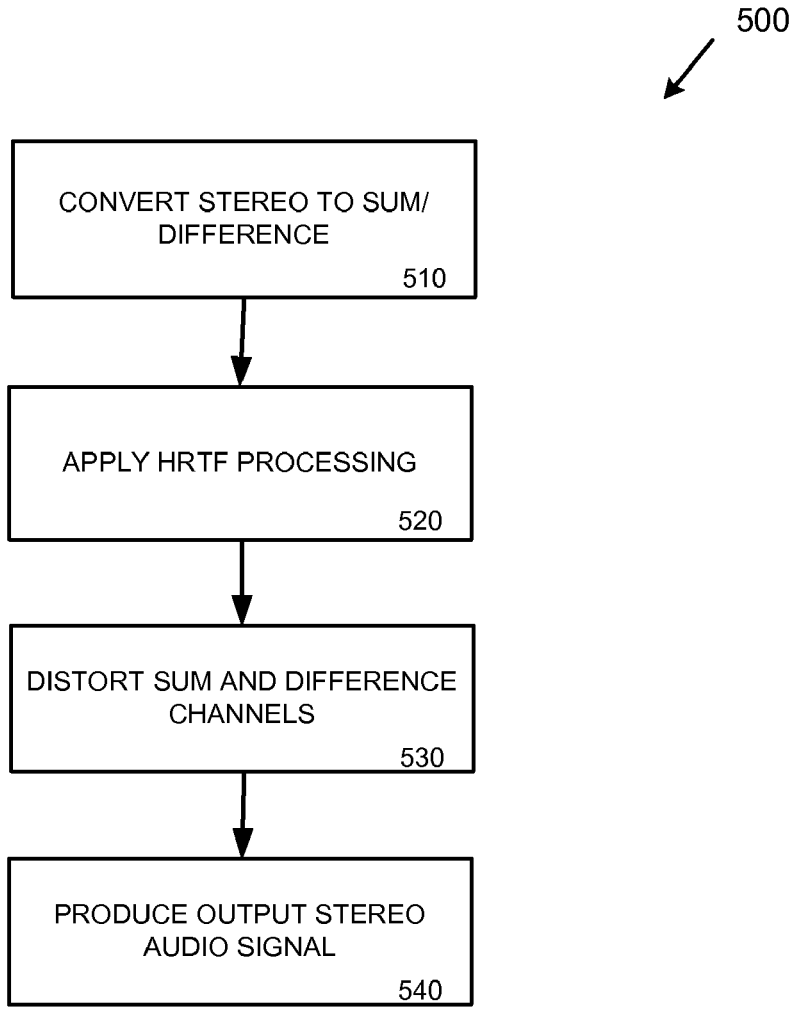
FIG. 5 depicts an example method for widening a stereo image, including applying HRTF processing.

FIG. 5 depicts an example method 500 for widening a stereo image of a stereo audio signal. At 510, a stereo audio signal is converted to a sum-difference audio signal. The conversion is accomplished by adding the left and right channels together to produce the sum channel, and by subtracting the right channel from the left channel to produce the difference channel.

At 520, HRTF processing is applied to the difference channel. In a specific implementation, the HRTF processing is applied using a linear phase filter.

In some implementations, HRTF processing is applied to only the difference channel (and not to the sum channel). In other implementations, HRTF processing is applied to both the sum and difference channels. In some situations, applying HRTF processing to the sum channel as well as the difference channel can improve the widening effect, but it can also lead to decreased audio quality.

At 530, the sum and difference channels are distorted. In some implementations, the sum and difference channels are distorted differently. For example, distortion can be applied using an Nth-order non-linearity, with a stronger Nth-order non-linearity being applied to the difference channel. In a specific implementation, a fourth-order non-linearity is applied to the sum cannel and a stronger fourth-order non-linearity is applied to the difference channel. Depending on the order of the non-linearity, upsampling can be performed before applying the distortion and downsampling can be performed after applying the distortion.

At 540, an output stereo audio signal is produced by converting sum-difference audio signal into the output stereo audio signal. The conversion is accomplished by adding the sum and difference channels together to produce the left channel, and by subtracting the sum channel from the difference channel to produce the right channel.

In some implementations, distortion 530 is not applied to the sum and difference channels. In this case stereo image widening is accomplished entirely via the HRTF processing 520.

Figure 6:
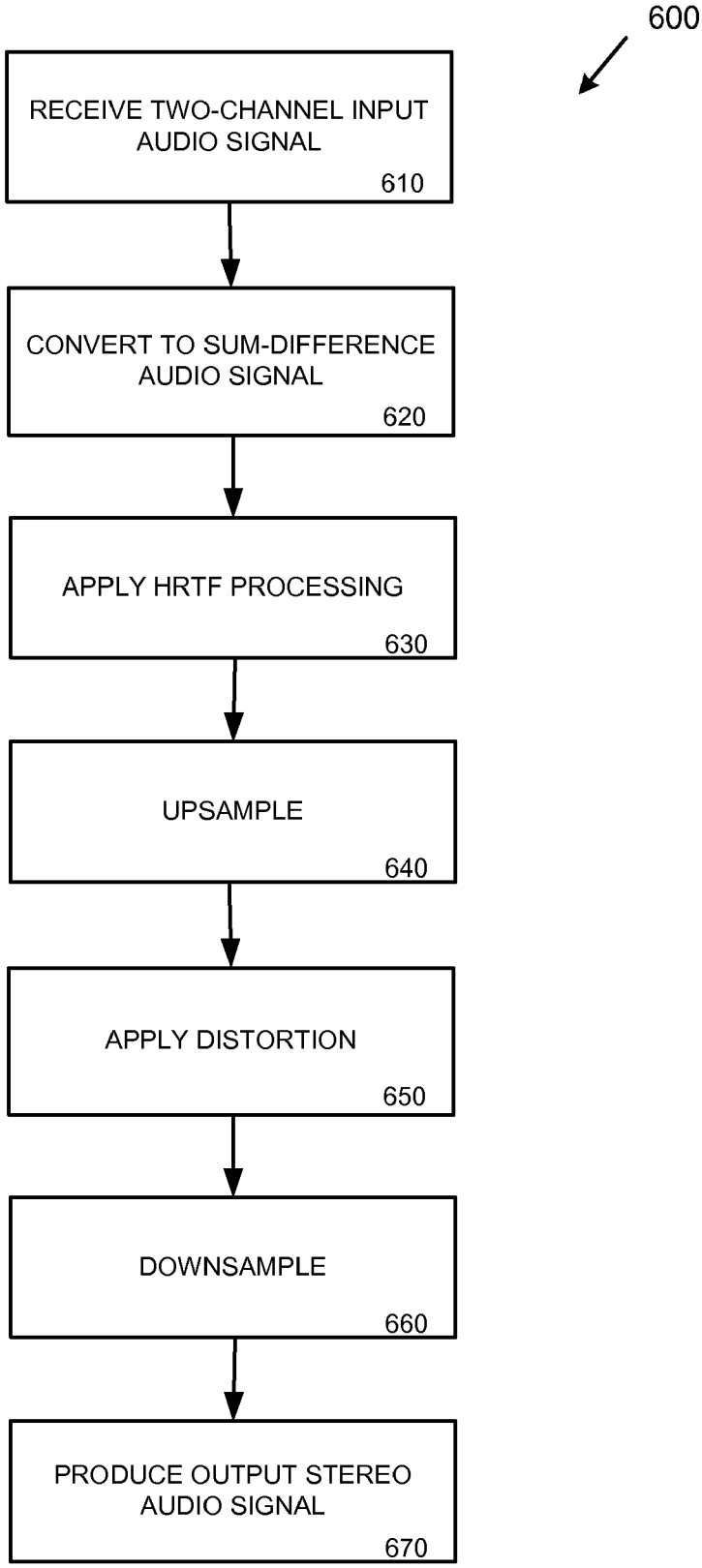
FIG. 6 depicts an example method for widening a stereo image, including applying HRTF processing and distortion.

FIG. 6 depicts an example method 600 for widening a stereo image of a stereo audio signal. At 610, a two-channel stereo input audio signal is received. At 620, the two-channel input audio signal is converted to into a two-channel sum-difference audio signal. The conversion is accomplished by adding the left and right channels together to produce the sum channel, and by subtracting the right channel from the left channel to produce the difference channel.

At 630, HRTF processing is applied to only the difference channel (and not the sum channel). In a specific implementation, the HRTF processing is applied using a linear phase filter.

At 640, the two-channel sum-difference audio signal is upsampled.

At 650, distortion is applied to the two-channel sum-difference audio signal. In some implementations, the sum and difference channels are distorted differently (e.g., a first distortion is applied to the sum channel and a second different distortion is applied to the difference channel). For example, distortion can be applied using an Nth-order non-linearity, with a stronger Nth-order non-linearity being applied to the difference channel. In a specific implementation, a fourth-order non-linearity is applied to the sum cannel and a stronger fourth-order non-linearity is applied to the difference channel.

At 660, the two-channel sum-difference audio signal is downsampled. In a specific implementation where a fourth-order non-linearity is used when applying the distortion 650, the upsampling 640 and downsampling 660 are by a factor of four.

At 670, a two-channel output stereo audio signal is produced by converting the HRTF-processed and distorted two-channel sum-difference audio signal into the two-channel output stereo audio signal.

The stereo image widening techniques and solutions described in this application can be used in various combinations to widen the stereo image of an audio signal. For example, a stereo audio signal can be converted to a sum-difference audio signal. HRTF processing can be applied to only the difference channel. Distortion can be applied to the sum-difference audio signal (e.g., with stronger distortion being applied to the difference channel). The sum-difference audio signal can be converted to a left-right stereo audio signal. Crossfeed can be applied between left and right channels of a stereo audio signal.

Any of the methods described herein can be performed via one or more computer-readable media (e.g., storage or other tangible media) comprising (e.g., having or storing) computer-executable instructions for performing (e.g., causing a computing device, audio processing device, or computer to perform) such methods. Operation can be fully automatic, semi-automatic, or involve manual intervention.

Having described and illustrated the principles of my innovations in the detailed description and accompanying drawings, it will be recognized that the various embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of embodiments shown in software may be implemented in hardware and vice versa.

In view of the many possible embodiments to which the principles of my invention may be applied, I claim as my invention all such embodiments as may come within the scope and spirit of the following claims and equivalents thereto.

I claim:

1. A method for stereo image widening using digital audio processing, the method comprising:

converting a stereo audio signal into a sum-difference audio signal;

applying head-related transfer function (HRTF) processing to only a difference channel of the sum-difference audio signal;

applying, after the HRTF processing, a first distortion to a sum channel of the sum-difference audio signal and a second distortion to the difference channel of the sum-difference audio signal, wherein the first distortion is different from the second distortion; and producing an output stereo audio signal by converting the HRTF-processed sum-difference audio signal into the output stereo audio signal.

2. The method of claim 1 wherein the first distortion is applied using an Nth-order non-linearity, and wherein the second distortion is applied using a stronger Nth-order non-linearity.

3. The method of claim 1 wherein the first distortion is applied using a fourth-order non-linearity, and wherein the second distortion is applied using a stronger fourth-order non-linearity.

4. The method of claim 1 wherein the first and second distortion are applied using non-linear processing, the method further comprising:

before applying the first and second distortion, upsampling the sum-difference audio signal by a factor greater than or equal to a highest order non-linearity; and after applying the first and second distortion, downsampling the sum-difference audio signal by said factor.

5. The method of claim 1 further comprising:

applying non-linear processing to the HRTF-processed sum-difference audio signal, wherein the non-linear processing comprises:

upsampling the sum-difference audio signal by a factor of four;

applying the first distortion to the sum channel of the sum-difference audio signal using a fourth order non-linearity;

applying the second distortion to the difference channel of the sum-difference audio signal using a stronger fourth order non-linearity; and downsampling the distorted sum-difference audio signal by a factor of four.

6. The method of claim 1 wherein the HRTF processing is applied using a linear phase filter.

7. The method of claim 1 wherein the converting the stereo audio signal into the sum-difference audio signal comprises:

creating the sum audio channel of the sum-difference audio signal by adding a left and a right audio channel of the stereo audio signal; and creating the difference audio channel of the sum-difference audio signal by subtracting the right audio channel of the stereo audio signal from the left audio channel of the stereo audio signal.

8. The method of claim 1 wherein HRTF processing is applied using a 30-degree HRTF.

9. The method of claim 1 wherein the method is implemented, at least in part, by an audio processing device.

10. A system for widening a stereo image, the system comprising:

an input module configured to convert a stereo audio signal into a sum-difference audio signal;

a head-related transfer function (HRTF) module configured to apply HRTF processing to only a difference channel of the sum-difference audio signal;

a distortion module configured to apply a first distortion to a sum channel of the HRTF-processed sum-difference audio signal and a second distortion to the difference channel of the HRTF-processed sum-difference audio signal, wherein the first distortion is different from the second distortion; and an output module configured to produce an output stereo audio signal by converting the HRTF-processed and distorted sum-difference audio signal into the output stereo audio signal.

11. The system of claim 10 wherein the first distortion is applied using an Nth order non-linearity, and wherein the second distortion is applied using a stronger Nth order non-linearity.

12. The system of claim 10 wherein the first distortion is applied using a fourth order non-linearity, and wherein the second distortion is applied using a stronger fourth order non-linearity.

13. The system of claim 10 wherein the first and second distortion are applied using non-linear processing, and wherein the distortion module is further configured to upsmaple, before applying the first and second distortion, the sum-difference audio signal by a factor greater than or equal to a highest order non-linearity and downsample, after applying the first and second distortion, the sum-difference audio signal by said factor.

14. The system of claim 10 further comprising:

a cross-mixing module configured to apply cross-channel mixing between left and right audio channels of the output stereo audio signal.

15. A method for stereo image widening using digital audio processing, the method comprising:

receiving a two-channel stereo input audio signal comprising left and right channels;

converting the two-channel stereo input audio signal into a two-channel sum-difference audio signal, wherein the two-channel sum-difference audio signal comprises a sum channel and a difference channel;

applying head-related transfer function (HRTF) processing to only the difference channel of the two-channel sum-difference audio signal;

upsampling the two-channel sum-difference audio signal;

applying a first distortion to the sum channel of the two-channel sum-difference audio signal and a second distortion to the difference channel of the two-channel sum-difference audio signal, wherein the first distortion is different from the second distortion;

downsampling the two-channel sum-difference audio signal; and producing a two-channel stereo output audio signal by converting the HRTF-processed and distorted two-channel sum-difference audio signal into the two-channel stereo output audio signal.

16. The method of claim 15 wherein the first distortion is applied using a fourth-order non-linearity, wherein the second distortion is applied using a stronger fourth-order non-linearity, and wherein the upsampling and the downsampling are by a factor of four.

17. The method of claim 15 further comprising:

applying cross-channel mixing between left and right channels of the two-channel stereo output audio signal.

18. A method for stereo image widening using digital audio processing, the method comprising:

converting a stereo audio signal into a sum-difference audio signal;

applying head-related transfer function (HRTF) processing to a difference channel of the sum-difference audio signal;

applying, after the HRTF processing, a first distortion to a sum channel of the sum-difference audio signal and a second distortion to the difference channel of the sum-difference audio signal, wherein the first distortion is different from the second distortion, wherein the first distortion is applied using a fourth order non-linearity, and wherein the second distortion is applied using a stronger fourth order non-linearity; and producing an output stereo audio signal by converting the HRTF-processed sum-difference audio signal into the output stereo audio signal.

19. The method of claim 18 further comprising:

upsampling the sum-difference audio signal by a factor of four;

applying the first distortion to the sum channel of the sum-difference audio signal using the fourth order non-linearity;

applying the second distortion to the difference channel of the sum-difference audio signal using the stronger fourth order non-linearity; and downsampling the distorted sum-difference audio signal by a factor of four.

20. The method of claim 18 wherein the method is implemented, at least in part, by an audio processing device.

* * * * *

UNITED STATES PATENT AND TRADEMARK OFFICE

CERTIFICATE OF CORRECTION

PATENT NO. : 8,144,902 B2
APPLICATION NO. : 11/945789
DATED : March 27, 2012
INVENTOR(S) : Johnston It is certified that error appears in the above-identified patent and that said Letters Patent is hereby corrected as shown below:

On the Title Page, in item [56], under "Other Publications" column 2, line 6, delete "page" and insert -- pages --, therefor.

In the Claims

Column 10, lines 39-40, Claim 13, delete "upsmaple," and insert -- upsample, --, therefor.

Signed and Sealed this
Seventeenth Day of February, 2015

Michelle K. Lee

Michelle K. Lee
*Deputy Director of the United States Patent and Trademark Office*